United States Patent [19]

Sterel

[11] 4,261,394

[45] Apr. 14, 1981

[54] PROJECTILE FEEDER FOR A GRIPPER PROJECTILE WEAVING MACHINE

[75] Inventor: Willem Sterel, Winterthur, Switzerland

[73] Assignee: Sulzer Brothers Ltd., Winterthur, Switzerland

[21] Appl. No.: 957,696

[22] Filed: Nov. 6, 1978

[30] Foreign Application Priority Data

Nov. 8, 1977 [CH] Switzerland ..... 13560/77

[51] Int. Cl.[3] ..... D03D 47/24

[52] U.S. Cl. ..... 139/439

[58] Field of Search ..... 139/437, 438, 439

[56] References Cited

U.S. PATENT DOCUMENTS

| | | | |
|---|---|---|---|
| 3,416,572 | 12/1968 | Giauini | 139/439 |
| 3,881,524 | 5/1975 | Bracher et al. | 139/439 |

*Primary Examiner*—Henry Jaudon

*Attorney, Agent, or Firm*—Kenyon & Kenyon

[57] ABSTRACT

The pivotable projectile feeder has a trough at one end which is shaped to the shape of the gripper shuttle. The trough has an aperture on a side remote from the transfer position to permit the weft yarn to pass freely therethrough when the feeder is returned to the transfer position after picking.

4 Claims, 2 Drawing Figures

PROJECTILE FEEDER FOR A GRIPPER PROJECTILE WEAVING MACHINE

Figure 1:
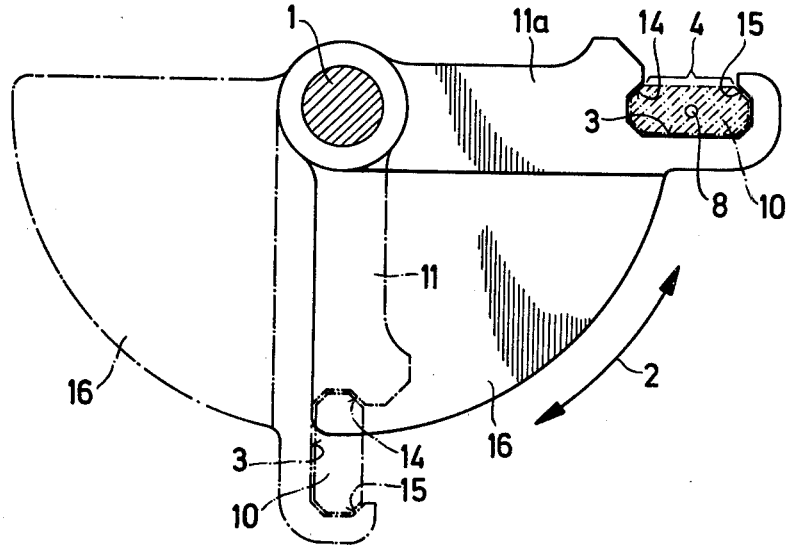

This invention relates to a projectile feeder for a gripper projectile weaving machine.

As is known, various types of gripper projectile weaving machines are provided with a projectile feeder which is pivotable from a projectile transfer position in which a projectile or shuttle is received to a picking position from which the projectile can be picked into a shed with a weft yarn clamped therein. A conventional projectile feeder of this type is described, for example, in German Pat. No. 1,009,567. This projectile feeder has a shell shape and, when the feeder is in the picking position, a projectile lies flush in the shell. In this instance, the shell is substantially closed at the top by a cover with the remaining gap over the projectile being covered by an edge of the picking mechanism employed for picking the projectile from the feeder. However, when the feeder pivots back from the horizontal picking position to a vertical transfer position, the weft yarn which has been clamped in the projectile may catch on the top cover of the feeder and remain in the feeder. Thus, the weft yarn may jump out of the feeder only after the feeder has been pivoted back towards the transfer position. In such cases, the weft yarn may be soiled. Further, if the weft yarn is made of a synthetic material containing discrete fibrils, these discrete fibrils may catch on the cover of the feeder, particularly at the interface between the feeder and the shell. In such cases, the fibrils may be torn off the fiber. In addition, the weft yarn may experience unnecessary pulling during the return of the feeder to the transfer position.

Accordingly, it is an object of the invention to provide a projectile feeder which does not interfere with a weft yarn being picked.

It is another object of the invention to avoid catching of a weft yarn on a projectile feeder which is pivotable from a picking position to a projectile transfer position.

It is another object of the invention to prevent a pivotable projectile feeder from soiling weft yarn during picking.

Briefly, the invention provides a projectile feeder for a gripper projectile weaving machine which includes an elongated body and a trough at one end of the body. The trough is of a cross-sectional shape corresponding to the cross-sectional shape of the gripper projectile and has an aperture on one side to permit a weft yarn to pass outwardly of the trough.

The projectile feeder is pivotally mounted on a pivot for pivoting between a projectile transfer position at which a gripper projectile can be inserted into the trough and a projectile picking position at which the gripper projectile can be picked, e.g. into a shed of a weaving machine. The aperture is positioned on the side of the feeder which is remote from the transfer position in order to allow the weft yarn in the projectile to pass through upon picking of the projectile from the picking position and movement of the feeder back to the transfer position. The weft yarn can therefor issue freely from the pivoting feeder.

Damage of the weft yarn, excessive pulling of the yarn and soiling of the yarn due to contact with the lubricated parts of the weaving machine during pivoting of the feeder can thus be avoided.

Figure 2:
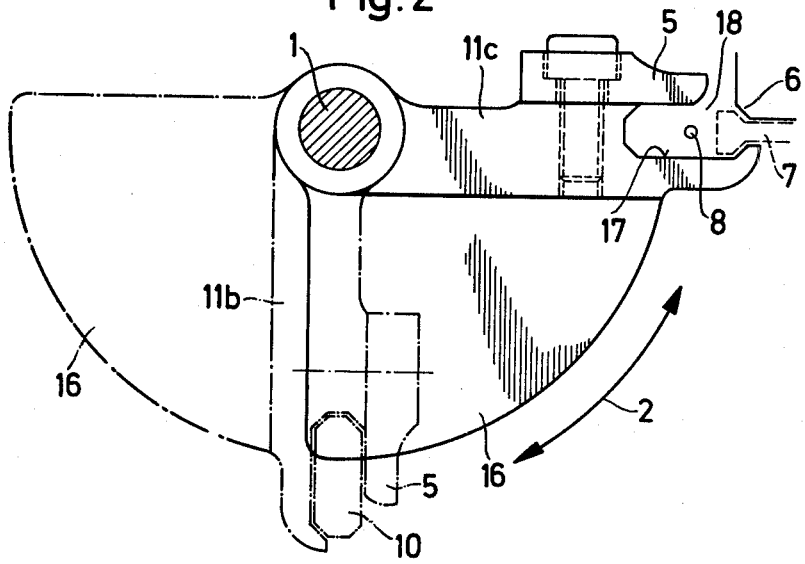

These and other objects and advantages of the invention will become more apparent from the following detailed description taken in conjunction with the accompanying drawings wherein:

FIG. 1 illustrates an end-view of a projectile feeder constructed in accordance with the invention; and FIG. 2 illustrates a view similar to FIG. 1 of a known feeder for purposes of comparison.

Referring to FIG. 1, the projectile feeder 11 is adapted to be used in a gripper projectile (or shuttle) weaving machine (not shown). To this end, the feeder 11 is pivotally mounted on a pivot 1 to pivot in a direction as indicated by an arrow 2 between a vertical projectile transfer position and a horizontal projectile picking position. The feeder 11 is formed of a one-piece elongated body which extends along a longitudinal axis radially of the pivot. The feeder has a hub surrounding the pivot 1 and a trough 3 integrally formed at the free end of the body for receiving a gripper projectile 10. The hub is secured to the pivot 1 in any suitable manner to follow the pivoting motion of the pivot 1. The trough 3 is of a cross-sectional shape corresponding to the cross-sectional shape of the gripper projectile 10.

With the feeder 11 in the vertical transfer position, as shown in chain-dotted lines, a gripper projectile 10 which is supplied by a return conveyor (not shown) enters into the trough 3. Thereafter, the feeder 11 is pivoted through an arc of 90° into the horizontal position, as shown in solid lines, in which the projectile 10 engages a weft yarn 8 which is offered thereto by a yarn transfer element (not shown) or the like. As indicated, the weft yarn 8 is received at the center of the cross-section of the gripper projectile 10.

The trough 3 also has an aperture 4 on the side remote from the transfer position (i.e. the upper side as viewed) in order to allow the weft yarn 8 trailing from the projectile 10 to pass through upon picking of the projectile 10 from the picking position and return movement of the feeder 11 to the transfer position. As shown, when the feeder 11 and projectile 10 are in the horizontal position for picking, the aperture 4 is located above the weft yarn 8, i.e. above the picking path. This aperture 4 extends from an inclined guide surface 14 on one side of the trough 3 to a corresponding inclined guide surface 15 on the opposite side. As indicated, the surfaces 14, 15 face into the trough 3 on opposite sides to retain the gripper projectile 10 in the trough 3 perpendicularly of the longitudinal axis of the feeder. These inclined surfaces 14, 15 are spaced from each other in a plane parallel to the longitudinal axis of the feeder to define the aperture 4. As shown, the guide surface 15 is disposed on a hook-shaped part of the feeder 11 such that the guide surface 15 partially covers the peripheral region of the trough 3.

The feeder 11 also includes a plate 16 of quadrant shape which extends from the elongated body in order to prevent passage of a following gripper projectile from the return conveyor (not shown) through the transfer position when the feeder 11 is in the picking position shown in solid lines in FIG. 1.

When the feeder 11 pivots clockwise, as viewed, back to the vertical transfer position, the weft yarn 8 can issue from the trough 3 without hindrance through the aperture 4 without touching the feeder 11. As a result, the yarn is not soiled or, if the yarn is made of a synthetic material with discrete fibrils, the fibrils are not damaged nor are the fibrils pulled by engaging on the feeder 11.

Referring to FIG. 2, one known feeder has an arm which is movable from a vertical transfer position **11*b*** to a horizontal picking position 11*c*. This feeder, however, has a recess 17 which is partially covered over by a cover 5 which is bolted to the feeder. With the feeder in the picking position 11*c*, a stationary edge 6 of a picking mechanism partially covers the remaining gap above the recess 17. A striker 7 enters below this edge 6 to accelerate the projectile 10 before picking. During a downward pivoting of the known feeder, the weft yarn 8 may catch on the cover 5 and thus become soiled or disturbed in operation. As shown, the known feeder does not have a hook-shaped end to partially cover the peripheral region of the recess 17.

The invention thus provides a feeder of unitary construction in which issuance of a yarn from the trough 3 at the end of the feeder is not hindered. In this regard, it is noted that the size of the aperture 4 may vary. However, the size of the aperture 4 must be such as to permit the yarn 8 to issue freely at least in the central zone above the picking path. To this end, it may be sufficient to utilize a slot (not shown) above the picking path of the yarn 8. Such a slot may have rounded edges. The feeder may also be comprised of a number of elements so long as an aperture is provided through which the weft yarn can issue unhindered. Further, the pivot 1 about which the feeder pivots may be vertical.

What is claimed is:

1. A projectile feeder for a gripper projectile weaving machine, said feeder including a one-piece elongated body having a longitudinal axis and a trough at one end of a cross-sectional shape corresponding to the cross-sectional shape of a gripper projectile to be picked, said body being hook-shaped at said end perpendicularly of said axis to partially cover the peripheral region of said trough and having a first inclined surface on said hook-shaped end facing into said trough and a second inclined surface facing into said trough on an opposite side from said first inclined surface to retain a gripper projectile in said trough perpendicularly of said axis, said inclined surfaces being spaced from each other in a plane parallel to said axis to define an aperture therebetween to permit a weft yarn to pass outwardly of said trough.

2. In a gripper projectile weaving machine, the combination of a pivot; and a projectile feeder pivotally mounted on said pivot for pivoting between a projectile transfer position and a projectile picking position, said feeder haivng a longitudinal axis disposed radially of said pivot and a trough at one end for receiving a gripper projectile and being hook-shaped at said end perpendicularly of said axis to partially cover said trough, said trough being of a cross-sectional shape corresponding to the cross-sectional shape of a received gripper projectile and having a first inclined surface on said hook-shaped end facing into said trough and a second inclined surface facing into said trough on an opposite side from said first inclined surface to retain a gripper projectile in said trough perpendicularly of said axis, said inclined surfaces being spaced from each other in a plane parallel to said axis to define an aperture on one side remote from said transfer position to allow a weft yarn in said projectile to pass therethrough upon picking of the projectile from said picking position and movement of said feeder to said transfer position.

3. The combination as set forth in claim 2 wherein said feeder includes an elongated body having said trough therein and a plate extending from said body to prevent passage of a gripper projectile through said transfer position with said feeder in said picking position.

4. The combination as set forth in claim 2 wherein said feeder includes an elongated body having a hub surrounding said pivot and wherein said trough is intergrally formed therein.

* * * * *